US005112252A

United States Patent [19]

Harris

[11] Patent Number: 5,112,252

[45] Date of Patent: May 12, 1992

[54] INTRINSICALLY SAFE ELECTRICAL CONNECTOR

[75] Inventor: Paul Harris, Whitstable, England

[73] Assignee: Amphenol Corporation, Wallingford, Conn.

[21] Appl. No.: 698,340

[22] Filed: May 7, 1991

Related U.S. Application Data

[63] Continuation of Ser. No. 417,058, Oct. 4, 1989, abandoned.

[30] Foreign Application Priority Data

Oct. 5, 1988 [GB] United Kingdom ..... 8823387

[51] Int. Cl.[5] ..... H01R 9/03

[52] U.S. Cl. ..... 439/610; 439/108

[58] Field of Search ..... 439/95, 96, 97, 98, 439/101, 108, 320, 607, 608, 609, 610

[56] References Cited

U.S. PATENT DOCUMENTS

| | | | |
|---|---|---|---|
| 3,680,036 | 7/1952 | McCamis et al. . | |
| 4,310,213 | 1/1982 | Fetterolf, Sr. et al. | 439/320 |
| 4,592,612 | 6/1986 | Kikuta . | |
| 4,653,825 | 3/1985 | Olsson | 439/607 X |
| 4,702,710 | 10/1987 | Dittman et al. | 439/271 |
| 4,767,362 | 8/1988 | Moji | 439/610 X |
| 4,790,768 | 12/1988 | Domingues | 439/320 |
| 4,921,449 | 5/1990 | Fish | 439/610 |

FOREIGN PATENT DOCUMENTS

| | | |
|---|---|---|
| 0084282A2 | 7/1983 | European Pat. Off. . |
| 603975 | 6/1948 | United Kingdom . |
| 715649 | 9/1954 | United Kingdom . |
| 955632 | 4/1964 | United Kingdom . |
| 1213827 | 11/1970 | United Kingdom . |
| 2012124A | 7/1979 | United Kingdom . |
| 2202393A | 9/1988 | United Kingdom . |

*Primary Examiner*—Larry I. Schwartz
*Assistant Examiner*—Khiem Nguyen
*Attorney, Agent, or Firm*—Bacon & Thomas

[57] ABSTRACT

A two part electrical connector, one part 10 of which comprises one or more electrical contacts 12 mounted in a connector shell 14 of insulating material. Around the contact or contacts 12 and connector shell 44 is a conductive casing 16 shaped to cooperate with a similar casing on the other part of the connector. The conductive casing 16 is electrically connected to the wire braiding 26 of the cable 22 via a metallic sleeve plate 24, to ensure continuity of the earth shielding across the connector. A non-conductive outer body 36 covers at least a part of the conductive casing b 16. Non-conductive material is also used for the clamp nut 40 which tightens the braiding clamp 30 and the connecting nut 44 which locks the two parts of the connector together. The resulting connector has earth shielding but no external conductive surfaces capable of being charged to high voltage potential should internal shorting occur.

10 Claims, 3 Drawing Sheets

INTRINSICALLY SAFE ELECTRICAL CONNECTOR

This application is a continuation of application Ser. No. 07/417,058, filed Oct. 4, 1989, abandoned.

BACKGROUND OF THE INVENTION

This invention relates to two-part electrical connectors and in particular to connectors of the cable mounted type. Connectors of the type typically used in, for example, data transmission cabling systems, such as twin-axial plugs, conventionally have a one piece metallic body which is neither earthed nor insulated. Such twin-axial plugs are often used in computer cabling systems and are thus likely to be accessible to office personnel with little technical knowledge. Furthermore, such connectors have means for locking the two parts of the connector together with the result that tension on the cable tends to result in damage within the connector rather than separation of the two connector parts. Such damage may involve breaking of electrical connections or fracture of plastics components. This may in turn result in the accidental connection of the metallic outer casing to a high voltage potential by way of one of the conductors in the cable. Such accidental connection can, of course, lead to injury of persons working on equipment connected by means of such cable mounted connectors or possible damage to the equipment itself.

SUMMARY OF THE INVENTION

In accordance with the present invention there is provided one part of a two part electrical connector, the said one part comprising one or more electrical contacts mounted in a connector shell of insulating material, a casing around the contact or contacts and the insulating shell, the said casing being of conductive material and so shaped as to contact a corresponding conductive casing in the other part of the said two part electrical connector when the two parts are connected, and a hollow outer body of non-conductive material covering at least a part of the conductive casing.

An embodiment of the invention will now be described in detail by way of example and with reference to the accompanying drawings in which.

DESCRIPTION OF THE PREFERRED EMBODIMENT

Figure 1:
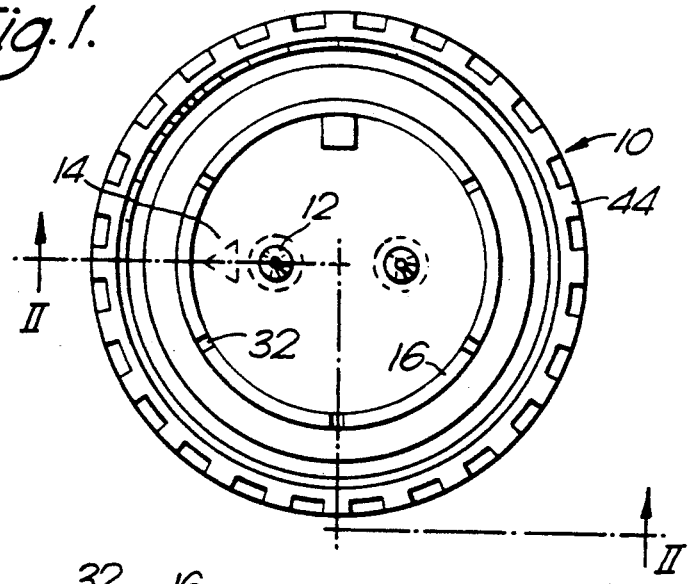
FIG. 1 is an end view of one part of a two-part twin axial electric connector.
Figure 2:
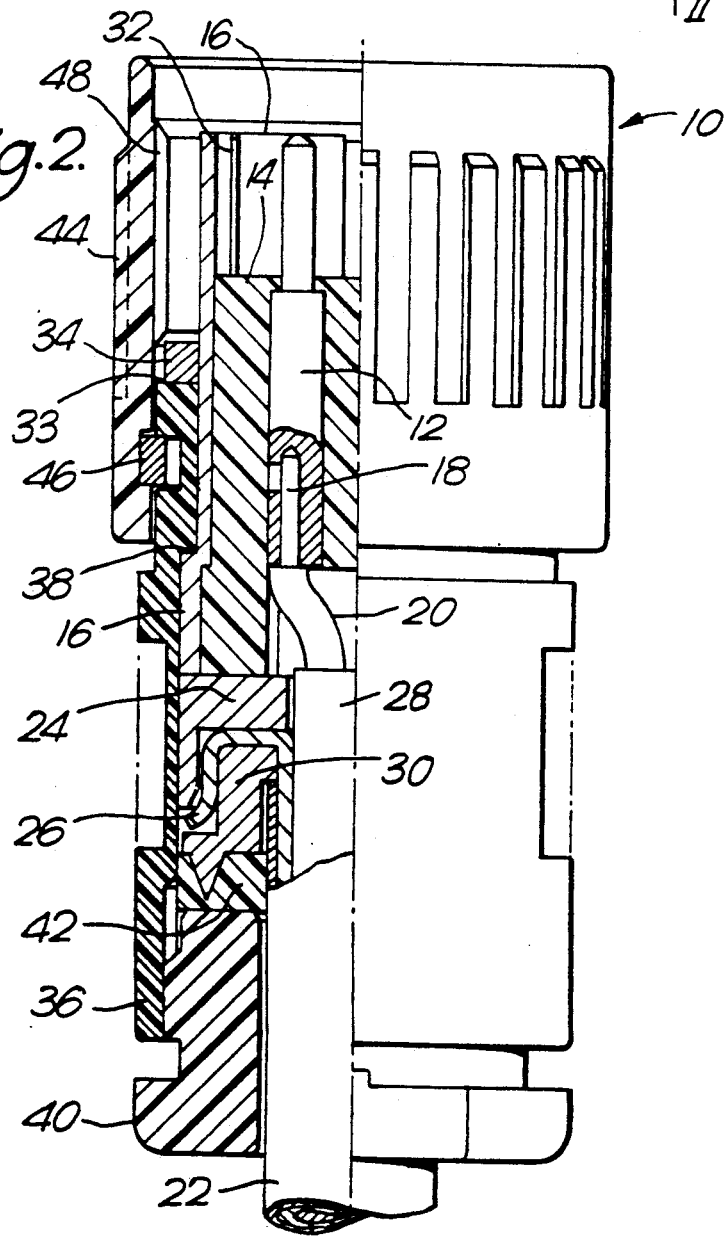
FIG. 2 is a section through the one part of FIG. 1.

FIG. 1 shows the end view of one part of a two part connector 10, the connector being for use with twin-axial (two-core) shielded cable.

The connector 10 has two spaced-apart male contacts 12 mounted in a connector shell 14 of insulating material. The connector shell 14 is itself rigidly mounted within a one-piece conductive casing 16. Each contact 12 has, at the end distant from the open end of the connector 10, means for connection to the uninsulated end 18 of one of the two conductors 20 carried in the cable 22. The conductor ends 18 may be attached to the contacts by, for example, welding or crimping.

The two conductors 20 pass through a sleeve plate 24. On the side of the sleeve plate 24 away from the contacts 12, the copper wire braiding 26 of the cable is stripped back from the secondary insulation layer 28 of the cable. The braiding 26 is clamped against the rear face of the sleeve plate 24 by a clamp block 30.

The sleeve plate 24 is of conductive material and is in electrical contact with the conductive casing 16. Thus, there is electrical connection between the cable braiding 26 and conductive casing 16.

Figure 4:
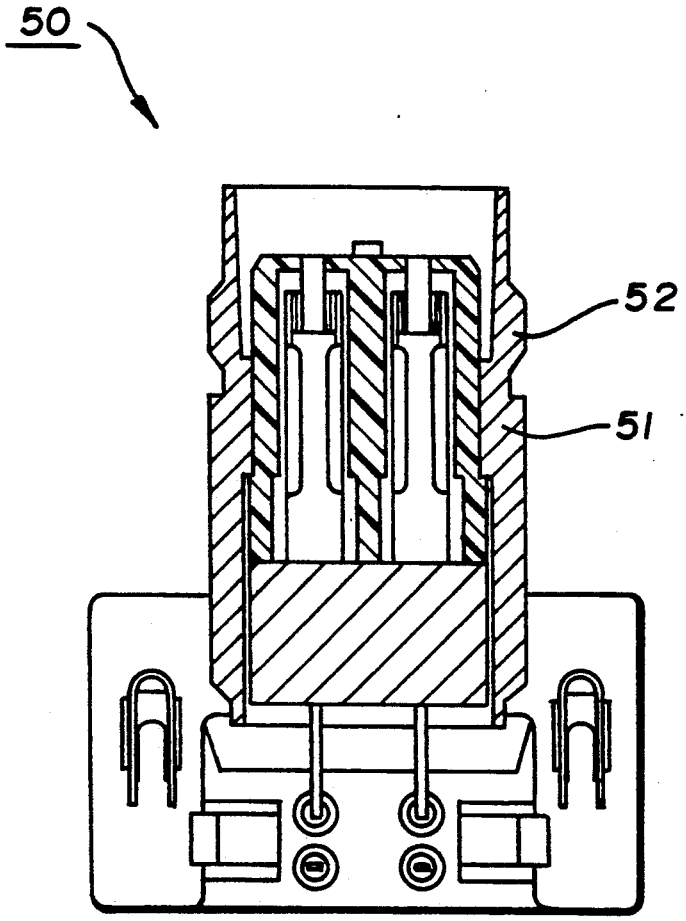
FIG. 4 is a section through a second connector part suitable for coupling with the connector part of FIGS. 1-3.

The conductive casing 16 is generally cylindrical, thereby providing a full 360° screening, and has a number of slots 32 running parallel to its axis over part of its length in the vicinity of the contacts 12. This enables it to firmly engage a similarly constructed further conductive casing 51 on the other part 50, shown in FIG. 4, of the two part connector, the extent of engagement being limited by a shoulder 33 on the outer surface of the conductive casing 16. A gasket 34 is trapped, in use, between the shoulder 33 and the edge of the other connector part 50 to provide a seal between the two parts of the connector. The connection of the braided shield 26 to the outer casing 16 ensures that the earth shielding provided by the braiding 26 in the cable 22 is continued across the connector part 10 with no discontinuity.

Figure 3:
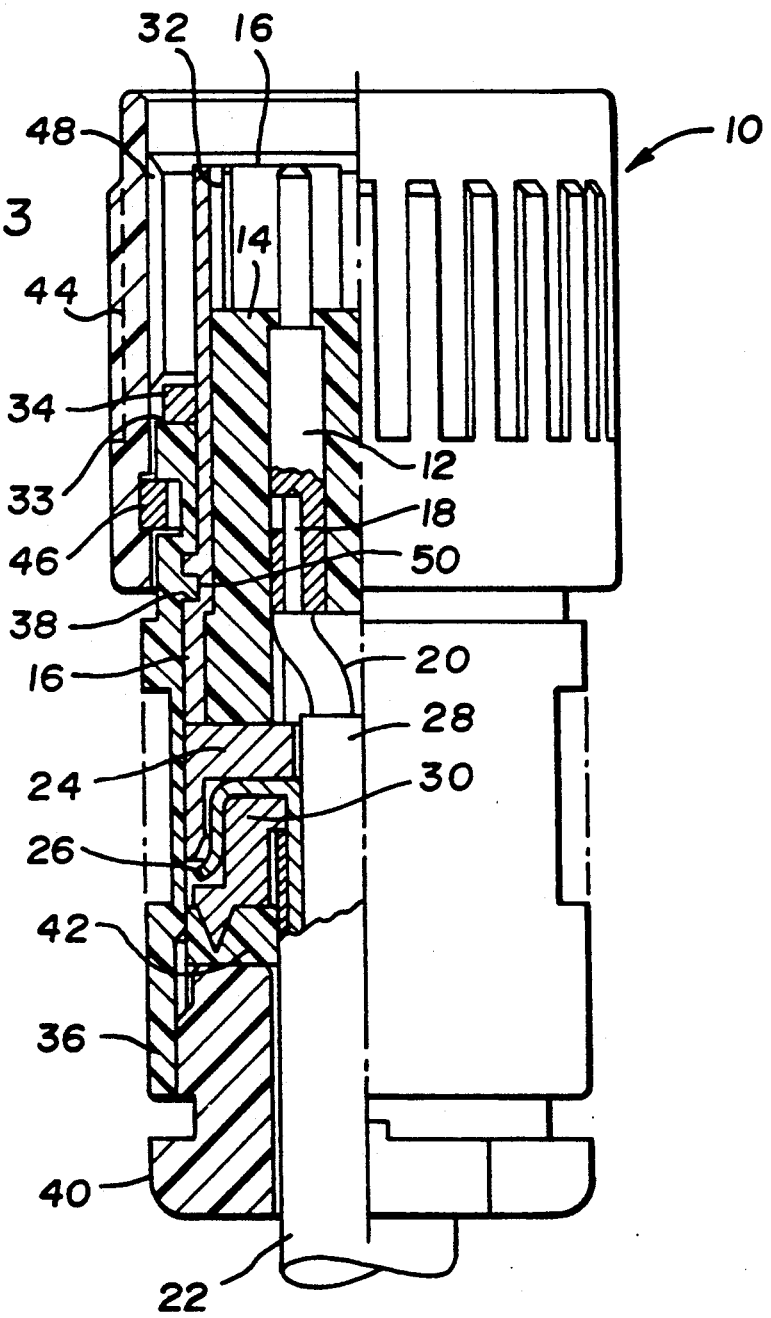
FIG. 3 is a section through one part of FIG. 1 showing an alternate embodiment of the invention.

Around the outside of the connector part 10 is a hollow outer body 36 of non-conductive plastics material. This contains the sleeve plate 24 and braiding clamp block 30 and partially overlaps the conductive casing 16. The outer body 36 has an inner lip 38 at the end nearest the two contacts 12; this lip 38 abuts a corresponding shoulder on the outer surface of the conductive casing 16 to prevent the conductive casing 16 moving toward the contact end of the connector part. Movement of the conductive casing 16 in the opposite direction is prevented by its abutment with the sleeve plate 24. The conductive casing 16 and hollow outer body 36 are thus held fixed relative to one another. In an alternative embodiment (shown in FIG. 3), the lip 38 engages a corresponding recess 50 in the outer surface of the conductive casing 16 to prevent it moving in either direction.

At the opposite end to the lip 38, the outer body 36 is internally threaded to accept an annular clamp nut 40 through which the cable 22 runs. Tightening of the clamp nut 40 puts pressure on the braiding clamp block 30 through a suitably shaped clamping gasket 42. The clamping nut 40 is also made from non-conductive plastics material.

This one part 10 of the two part connector has provision for locking of the connector parts together once a connection has been made. This is in the form of a coupling nut 44, formed as a hollow cylinder concentrically mounted outside the conductive casing 16. Longitudinally, the nut 44 extends from the lip 38 on the outer body 36 (which it partially overlaps) to beyond the end of the contacts 12 and conductive casing 16. The nut 44 is maintained in position by the use of a sprung ring 46 mounted in complementary recesses in the inner face of the nut 44 and outer face of the conductive casing 16. The the portion of the inner face of the nut adjacent the contacts 12 is threaded to engage an externally-threaded portion 52 of the other part of the two part connector. Like the outer body 36 and clamping nut 40, the coupling nut 44 is made of non-conducting plastics material.

Thus, no part of the external surface of the connector 10 may become electrically live when the two parts of the connector are locked together even if internal short circuiting occurs. The use of a non-conductive outer body 36 to cover the conductive casing 16 in combination with a coupling nut 44 and clamp nuts 40 of insulating material provides a connector which is both internally shielded and externally insulated.

I claim:

1. An electrical connector member comprising one or more electrical contacts mounted in a connector shell of insulating material, a generally cylindrical one-piece casing around the contact or contacts and the insulating shell, said casing being of conductive material and shaped so as to contact a corresponding conductive casing in a second electrical connector member when the two members are connected and so as to provide a full 360° screening, locking means which co-operate with means on said second connector member to lock the two members together when connected, and a hollow outer body covering at least a part of the conductive casing, wherein the locking means and the hollow outer body are of non-conductive material and the hollow outer body is partially overlapped by said locking means, the locking means and hollow outer body together forming a continuous outer casing of non-conductive material.

2. The electrical connector member according to claim 1 having means for electrically connecting the earth shield of a cable terminated thereby to the conductive casing therein.

3. An electrical connector member according to claim 2, wherein said means for electrically connecting the earth shield comprises a cable braiding clamp, at least one part of which is conductive and in electrical contact with the conductive casing.

4. An electrical connector member according to claim 1 including a clamp means at the rear of the connector member remote from the contacts, the clamp means being of non-conductive material and substantially filling the space between the rearward end of the hollow outer body and a cable to which the connector member is coupled.

5. An electrical connector member according to claim 1 wherein the non-conductive components are of plastics material.

6. An electrical connector member according to claim 1 wherein the hollow outer body and conductive casing are held fixed relative to one another by the engagement of a projection formed on one with a corresponding recess on the other.

7. An electrical connector member according to claim 4 where the conductive casing is prevented from moving in a first direction relative to the hollow outer body by abutment with the clamp means and in the opposite direction by abutment of a shoulder on the outer surface of said conductive casing with a discontinuity on the inner surface of said hollow outer body.

8. An electrical connector assembly as claimed in claim 1, further comprising said second electrical connector member.

9. An electrical connector member according to claim 1, having two electrical contacts for connection to a twin axial cable.

10. An electrical connector member comprising one or more electrical contacts mounted in a connector shell of insulating material, a casing around the contact or contacts and the insulating shell, said casing being of conductive material and shaped so as to contact a corresponding conductive casing in a second electrical connector member when the two members are connected, locking means which co-operate with means on said second connector member to lock the two members together when connected, said locking means including a generally cylindrical coupling member substantially concentrically mounted outside said casing and a hollow outer body covering at least a part of the conductive casing, wherein the locking means and the hollow outer body are of non-conductive material and the hollow outer body is partially overlapped by said locking means, the locking means and hollow outer body together forming a continuous outer casing of non-conductive material.

* * * * *